US011499106B2

(12) United States Patent
Smith et al.

(10) Patent No.: US 11,499,106 B2
(45) Date of Patent: Nov. 15, 2022

(54) FUEL COMPOSITIONS

(71) Applicant: SHELL OIL COMPANY, Houston, TX (US)

(72) Inventors: Alastair Graham Smith, London (GB); Claire Griffiths, E15 5NR (GB); Mark Clift Southby, London (GB); Tushar Bera, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/293,721

(22) PCT Filed: Nov. 22, 2019

(86) PCT No.: PCT/EP2019/082317
§ 371 (c)(1),
(2) Date: May 13, 2021

(87) PCT Pub. No.: WO2020/109184
PCT Pub. Date: Jun. 4, 2020

(65) Prior Publication Data

US 2022/0002627 A1 Jan. 6, 2022

Related U.S. Application Data

(60) Provisional application No. 62/771,392, filed on Nov. 26, 2018.

(51) Int. Cl.
*C10L 1/238* (2006.01)
*C10L 1/236* (2006.01)

(52) U.S. Cl.
CPC ..... *C10L 1/236* (2013.01); *C10L 2200/0446* (2013.01); *C10L 2230/22* (2013.01); *C10L 2270/026* (2013.01)

(58) Field of Classification Search
CPC .. C10L 1/236; C10L 1/238; C10L 2200/0446; C10L 2230/22; C10L 2270/026
See application file for complete search history.

(56) References Cited

U.S. PATENT DOCUMENTS

| | | | |
|---|---|---|---|
| 2,579,692 | A | 12/1951 | Neudeck |
| 4,125,566 | A | 11/1978 | Trin Dinh et al. |
| 4,208,190 | A | 6/1980 | Malec |
| 4,385,193 | A | 5/1983 | Bijwaard et al. |
| 4,478,955 | A | 10/1984 | Pesa et al. |
| 4,933,098 | A | 6/1990 | Gutierrez et al. |
| 5,139,688 | A | 8/1992 | Nalesnik |
| 5,393,309 | A | 2/1995 | Cherpeck |
| 5,458,792 | A | 10/1995 | Rhodes et al. |
| 5,490,864 | A | 2/1996 | Herbstman et al. |
| 5,616,153 | A | 4/1997 | Mike et al. |
| 5,906,665 | A | 5/1999 | Trippe et al. |
| 6,107,257 | A | 8/2000 | Valcho et al. |
| 6,107,258 | A | 8/2000 | Esche, Jr. et al. |
| 6,248,702 | B1 | 6/2001 | Coolbaugh et al. |
| 6,514,298 | B2 | 2/2003 | Haji et al. |
| 7,638,661 | B2 | 12/2009 | Davenport et al. |
| 7,892,301 | B2 | 2/2011 | Waters et al. |
| 8,006,677 | B2 | 8/2011 | Williams et al. |
| 2002/0151756 | A1 | 10/2002 | Schilowitz et al. |
| 2003/0159337 | A1 | 8/2003 | Davenport et al. |
| 2006/0040833 | A1 | 2/2006 | Al-Akhdar et al. |
| 2007/0099802 | A1 | 5/2007 | Scott |
| 2007/0100177 | A1 | 5/2007 | Clark et al. |
| 2007/0175090 | A1 | 8/2007 | Haan et al. |
| 2007/0265479 | A1 | 11/2007 | Landschof |
| 2007/0266622 | A1 | 11/2007 | Hu |
| 2020/0115648 | A1* | 4/2020 | Jiang ..... C08F 255/04 |

FOREIGN PATENT DOCUMENTS

| | | | | |
|---|---|---|---|---|
| CN | 1576369 | A | 2/2005 | |
| CN | 1876780 | A | 12/2006 | |
| DE | 204491 | A1 | 11/1983 | |
| EP | 0147240 | A2 | 7/1985 | |
| EP | 0147873 | A1 | 7/1985 | |
| EP | 0482253 | A1 | 4/1992 | |
| EP | 0557516 | A1 | 9/1993 | |
| EP | 0583836 | A1 | 2/1994 | |
| EP | 0613938 | A1 | 9/1994 | |
| EP | 1433800 | A1 * | 6/2004 | ..... C10M 143/10 |
| EP | 1433800 | A1 | 6/2004 | |
| GB | 960493 | A | 6/1964 | |
| JP | S5364206 | A | 6/1978 | |
| JP | H0995795 | A | 4/1997 | |
| JP | 2000087052 | A | 3/2000 | |

(Continued)

OTHER PUBLICATIONS

Van Der Burgt et al., "The Shell Middle Distillate Synthesis Process", paper delivered at 5th Synfuels Worldwide Symposium, Nov. 1985, pp. 1-15.

Van Der Burgt et al., "The Shell Middle Distillate Synthesis Process", Shell International Petroleum Company Ltd., Nov. 1989. pp. 1-8.

Wei et al., "The Lubricity of Diesel Fuel", Wear, vol. 111, Issue No. 2, Sep. 1986, pp. 217-235.

International Search Report and Written Opinion Received for PCT Application No. PCT/EP2004/053152, dated Mar. 16, 2005, 10 pages.

International Search Report and Written Opinion Received for PCT Application No. PCT/EP2009/053416, dated Oct. 21, 2009, 15 pages.

(Continued)

*Primary Examiner* — Ellen M McAvoy
*Assistant Examiner* — Chantel L Graham
(74) *Attorney, Agent, or Firm* — Shell Usa, Inc.

(57) ABSTRACT

A fuel composition comprising a base fuel and at least one viscosity index (VI) improving additive, wherein the viscosity index (VI) improving additive is a functionalized dispersant olefin copolymer. The viscosity index (VI) improving additive provides improved power output and/or acceleration characteristics.

12 Claims, No Drawings

(56) References Cited

FOREIGN PATENT DOCUMENTS

| | | | | |
|---|---|---|---|---|
| JP | 2001234778 | A | 8/2001 | |
| WO | 9417160 | A1 | 8/1994 | |
| WO | 9533805 | A1 | 12/1995 | |
| WO | WO-9712014 | A1 * | 4/1997 | ..... C10L 1/143 |
| WO | 9801516 | A1 | 1/1998 | |
| WO | 9842808 | A1 | 10/1998 | |
| WO | 0148120 | A1 | 7/2001 | |
| WO | 02084101 | A1 | 10/2002 | |
| WO | 2004056948 | A1 | 7/2004 | |
| WO | 2007106346 | A2 | 9/2007 | |
| WO | 2009118302 | A1 | 10/2009 | |

OTHER PUBLICATIONS

Fujita et al., "Semi-empirical, Theory of Viscosity of Moderately Dilute Polymer Solutions" Rheological Acta, vol. 25, Isue No. 5, Sep. 1986, pp. 487-493, XP002497846.

International Search Report and Written Opinion Received for PCT Application No. PCT/EP2019/082317, dated Jan. 29, 2020, 09 pages.

* cited by examiner

FUEL COMPOSITIONS

CROSS REFERENCE TO RELATED APPLICATIONS

This is a national stage application of International Application No. PCT/EP2019/082317, filed 22 Nov. 2019, which claims benefit of priority to U.S. Provisional application 62/771,392, filed 26 Nov. 2018.

FIELD OF THE INVENTION

The present invention relates to automotive fuel compositions, and in particular to automotive fuel compositions comprising viscosity index improver (VII) components.

BACKGROUND OF THE INVENTION

Viscosity index (VI) is a commonly used method of measuring a fluid's change of viscosity in relation to temperature. The higher the VI, the smaller the relative change in viscosity with temperature. VI improvers (also known as viscosity modifiers) are additives that increase the viscosity of the fluid throughout its useful temperature range.

It is known to use a viscosity increasing component in a fuel composition in order to improve acceleration performance. WO2009/118302 describes the use of a viscosity index (VI) improving additive, in an automotive fuel composition, for the purpose of improving the acceleration performance of an internal combustion engine into which the fuel composition is or is intended to be introduced or of a vehicle powered by such an engine.

It would be desirable to be able to further improve the performance of a vehicle engine, by altering the composition and/or properties of the fuel introduced into it, as this can be expected to provide a more simple, flexible and cost effective route to performance optimisation than by making structural or operational changes to the engine itself.

In particular, as well as identifying new viscosity index (VI) improving additives which provide improvements in power and/or acceleration properties, it would be desirable to improve one or more other aspects of the fuel composition such as, for example, friction modification properties, lubricity, engine cleanliness, low temperature performance (as measured for example, by cloud point and cold filter plugging point (CFPP)), filterability properties and pumpability, especially at cold temperatures.

SUMMARY OF THE INVENTION

According to the present invention there is provided a fuel composition comprising a base fuel and at least one viscosity index (VI) improving additive, wherein the viscosity index (VI) improving additive is a functionalized dispersant olefin copolymer.

According to a second aspect of the present invention there is provided the use of a viscosity index (VI) improving additive in an automotive fuel composition, for the purpose of improving the power output of an internal combustion engine into which the viscosity index (VI) improving additive, or an automotive fuel composition containing the viscosity index (VI) improving additive, is or is intended to be introduced or of a vehicle powered by such an engine, wherein the viscosity index (VI) improving additive is a functionalized dispersant olefin copolymer.

According to a further aspect there is provided a method of operating an internal combustion engine, and/or a vehicle which is powered by such an engine, which method involves introducing into a combustion chamber of the engine a fuel composition described hereinbelow.

It has surprisingly been found that the viscosity index improvers described herein can be used in a fuel composition to provide improved power output and/or acceleration characteristics. It has also surprisingly been found that the viscosity index improvers described herein can be used in a fuel composition to provide improved power output and/or acceleration characteristics, even when used at low concentration levels in the fuel composition.

DETAILED DESCRIPTION OF THE INVENTION

As used herein the term 'viscosity index (VI) improver' means an additive that increases the viscosity of the fuel throughout its useful temperature range. Viscosity index improvers are also known as viscosity modifiers.

The fuel composition described herein is preferably a diesel fuel composition and the internal combustion engine described herein is preferably a diesel engine.

By "diesel engine" is meant a compression ignition internal combustion engine, which is adapted to run on a diesel fuel.

"Acceleration performance" includes generally the responsiveness of the engine to increased accelerator pedal position, for example the rate at which it accelerates from any given engine speed. It includes the level of power and/or torque and/or vehicle tractive effort (VTE) generated by the engine at any given speed. Thus an improvement in acceleration performance may be manifested by an increase in engine power and/or torque and/or VTE at any given speed.

Engine torque may be derived from the force exerted on a dynamometer by the wheel(s) of a vehicle which is powered by the engine under test. It may, using suitably specialised equipment (for example the Kistler™ RoaDyn™), be measured directly from the wheels of such a vehicle. Engine power may suitably be derived from measured engine torque and engine speed values, as is known in the art. VTE may be measured by measuring the force exerted, for example on the roller of a chassis dynamometer, by the wheels of a vehicle driven by the engine.

The present invention can be of use in improving the acceleration performance of an internal combustion engine or of a vehicle powered by such an engine. Acceleration performance may be assessed by accelerating the engine and monitoring changes in engine speed, power, torque and/or VTE, air charge pressure and/or turbo charger speed with time. This assessment may suitably be carried out over a range of engine speeds.

Acceleration performance may also be assessed by a suitably experienced driver accelerating a vehicle which is powered by the engine under test, for instance from 0 to 100 km/hour, on a road. The vehicle should be equipped with appropriate instrumentation such as an engine speedometer, to enable changes in acceleration performance to be related to engine speed.

In general, an improvement in acceleration performance may be manifested by reduced acceleration times, and/or by any one or more of the effects described above, for example a faster increase in turbo charger speed, or an increase in engine torque or power or VTE at any given speed.

In the context of the present invention, an "improvement" in acceleration performance embraces any degree of improvement. Similarly a reduction or increase in a measured parameter—for example the time taken for the turbo charger to reach its maximum speed—embraces any degree of reduction or increase, as the case may be. The improvement, reduction or increase—as the case may be—may be as compared to the relevant parameter when using the fuel composition prior to incorporation of the viscosity index (VI) improving additive. It may be as compared to the relevant parameter measured when the same engine is run on an otherwise analogous fuel composition which is intended (e.g. marketed) for use in an internal combustion (typically diesel) engine, prior to adding a viscosity index (VI) improving additive to it.

The present invention may, for example, involve adjusting the properties and/or performance and/or effects of the fuel composition, in particular its effect on the acceleration and/or power output performance of an internal combustion engine, by means of the viscosity index (VI) improver, in order to meet a desired target.

An improvement in acceleration performance may also embrace mitigation, to at least a degree, of a decrease in acceleration performance due to another cause, in particular due to another fuel component or additive included in the fuel composition. By way of example, a fuel composition may contain one or more components intended to reduce its overall density so as to reduce the level of emissions which it generates on combustion; a reduction in density can result in loss of engine power, but this effect may be overcome or at least mitigated by the use of a viscosity index (VI) improver in accordance with the present invention.

An improvement in acceleration performance may also embrace restoration, at least partially, of acceleration performance which has been reduced for another reason such as the use of a fuel containing an oxygenated component (e.g. a so-called "biofuel"), or the build-up of combustion related deposits in the engine (typically in the fuel injectors).

Where the present invention is used to increase the engine torque, typically during a period of acceleration, at a given engine speed, the increase may be of at least 0.1%, preferably of at least 0.2 or 0.3 or 0.4 or 0.5%, in cases of at least 0.6 or 0.7%, compared to that obtained when running the engine on the fuel composition prior to incorporation of the viscosity index (VI) improver. The increase may be as compared to the engine torque obtained at the relevant speed when the same engine is run on an otherwise analogous fuel composition which is intended (e.g. marketed) for use in an internal combustion (typically diesel) engine prior to adding a viscosity index (VI) improver to it.

Where the present invention is used to increase the engine power, typically during a period of acceleration, at a given engine speed, the increase may again be of at least 0.1%, preferably of at least 0.2 or 0.3 or 0.4 or 0.5%, in cases of at least 0.6 or 0.7%, compared to that obtained when running the engine on the fuel composition prior to incorporation of the viscosity index improver. The increase may be as compared to the engine power obtained at the relevant speed when the same engine is run on an otherwise analogous fuel composition which is intended (e.g. marketed) for use in an internal combustion (typically diesel) engine prior to adding a viscosity index improver to it.

Where the present invention is used to increase the engine VTE, typically during a period of acceleration, at a given engine speed, the increase may again be of at least 0.1%, preferably of at least 0.2 or 0.3 or 0.4 or 0.5%, in cases of at least 0.6 or 0.7%, compared to that obtained when running the engine on the fuel composition prior to incorporation of the viscosity index (VI) improver. The increase may be as compared to the VTE obtained at the relevant speed when the same engine is run on an otherwise analogous fuel composition which is intended (e.g. marketed) for use in an internal combustion (typically diesel) engine prior to adding a viscosity index (VI) improver to it.

Where the present invention is used to reduce the time taken for the engine to accelerate between two given engine speeds, the reduction may be of at least 0.1%, preferably of at least 0.2 or 0.3 or 0.4 or 0.5%, in cases of at least 0.6 or 0.7 or 0.8 or 0.9%, compared to that taken when running the engine on the fuel composition prior to incorporation of the viscosity index (VI) improver. The reduction may be as compared to the acceleration time between the relevant speeds when the same engine is run on an otherwise analogous fuel composition which is intended (e.g. marketed) for use in an internal combustion (typically diesel) engine prior to adding a viscosity index (VI) improver to it. Such acceleration times may for instance be measured over an engine speed increase of 300 rpm or more, or of 400 or 500 or 600 or 700 or 800 or 900 or 1000 rpm or more, for example from 1300 to 1600 rpm, or from 1600 to 2200 rpm, or from 2200 to 3000 rpm, or from 3000 to 4000 rpm.

The automotive fuel composition in which the VI improving additive is used, in accordance with the present invention, may in particular be a diesel fuel composition suitable for use in a diesel engine. It may be used in, and/or may be suitable and/or adapted and/or intended for use in, any type of compression ignition engine, for instance those described below.

Viscosity index improving additives (also referred to as VI improvers) are already well known for use in lubricant formulations, where they are used to maintain viscosity as constant as possible over a desired temperature range by increasing viscosity at higher temperatures. They are typically based on relatively high molecular weight, long chain polymeric molecules that can form conglomerates and/or micelles. These molecular systems expand at higher temperatures, thus further restricting their movement relative to one another and in turn increasing the viscosity of the system.

The VI improving additives used in a fuel composition in accordance with the present invention comprise a functionalized dispersant olefin copolymer.

In one embodiment herein, a functionalized dispersant olefin copolymer is produced by reacting an olefin copolymer with a functionalizing component selected from amines, amides, nitrogen-containing heterocyclic compounds or alcohols.

In another embodiment herein, a functionalized dispersant olefin copolymer is produced from grafting an olefin copolymer with a grafting material and then reacting the grafted material with a functionalizing component selected from amines, amides, nitrogen-containing heterocyclic compounds or alcohols. In preferred embodiments herein, the grafted material is an unsaturated acid. In a particularly preferred embodiment herein, the grafted material is maleic anhydride.

In the functionalized dispersant olefin copolymers used herein, the olefin copolymer is preferably a copolymer of ethylene with a $C_3$ to $C_{20}$ olefin, preferably wherein the $C_3$ to $C_{20}$ olefin is selected from propylene, butylene, butadiene, isoprene, and mixtures thereof, more preferably propylene.

In preferred embodiments herein, the functionalizing component is an amine, preferably an aromatic amine, especially N-phenyl-1,4-phenylenediamine.

An example of a suitable functionalized dispersant olefin copolymer for use herein is Hitec 5777, commercially available from Afton. Hitec 5777 is described fully in U.S.

Pat. Nos. 5,139,688 and 6,107,257. It is a highly granted, amine derivatized functionalized ethylene-propylene copolymer.

The density of the viscosity index (VI) improving additive for use herein at 15.6° C. (ASTM D-4052) is 0.70 g/cm$^3$ or greater, preferably 0.75 g/cm$^3$ or greater.

The VI improving additive may be pre-dissolved in a suitable solvent, for example an oil such as a mineral oil or Fischer-Tropsch derived hydrocarbon mixture; a fuel component (which again may be either mineral or Fischer-Tropsch derived) compatible with the fuel composition in which the additive is to be used (for example a middle distillate fuel component such as a gas oil or kerosene, when intended for use in a diesel fuel composition); a poly alpha olefin; a so-called biofuel such as a fatty acid alkyl ester (FAAE), a Fischer-Tropsch derived biomass-to-liquid synthesis product, a hydrogenated vegetable oil, a waste or algae oil or an alcohol such as ethanol; an aromatic solvent; any other hydrocarbon or organic solvent; or a mixture thereof. Preferred solvents for use in this context are mineral oil based diesel fuel components and solvents, and Fischer-Tropsch derived components such as the "XtL" components referred to below. Biofuel solvents may also be preferred in certain cases.

The concentration of the VI improving additive in the fuel composition may be up to 1% w/w (10,000 ppm), suitably up to 0.5% w/w, in cases up to 0.4 or 0.3 or 0.25% w/w. It may be 0.001% w/w or greater, preferably 0.01% w/w or greater, suitably 0.02 or 0.03 or 0.04 or 0.05% w/w or greater, in cases 0.1 or 0.2% w/w or greater. Suitable concentrations may for instance be from 0.001 to 1% w/w, or from 0.001 to 0.5% w/w, or from 0.05 to 0.5% w/w, or from 0.05 to 0.25% w/w, for example from 0.05 to 0.25% w/w or from 0.1 to 0.2% w/w.

The remainder of the composition will typically consist of one or more automotive base fuels, for instance as described in more detail below, optionally together with one or more fuel additives.

The above concentrations are for the VI improving additive itself, and do not take account of any solvent(s) with which its active ingredient is pre-diluted. They are based on the mass of the overall fuel composition. Two or more VI improving additives can be used in the fuel composition herein. Where a combination of two or more VI improving additives is used in the composition, the same concentration ranges may apply to the overall combination, again minus any pre-solvent(s) present.

The concentration of the VI improving additive will depend on the desired viscosity of the overall fuel composition, the viscosity of the composition prior to incorporation of the additive, the viscosity of the additive itself and the viscosity of any solvent in which the additive is used. The relative proportions of the VI improving additive, fuel component(s) and any other components or additives present, in an automotive fuel composition prepared according to the present invention, may also depend on other desired properties such as density, emissions performance and cetane number, in particular density.

It has surprisingly been found that the VI improving additive described herein can improve the power output and/or acceleration characteristics, even at low concentration of the VI improving additive in the fuel composition.

Due to the inclusion of the VI improving additive, a fuel composition prepared according to the present invention (in particular a diesel fuel composition) will suitably have a VK 40 of 2.7 or 2.8 mm$^2$/s or greater, preferably 2.9 or 3.0 or 3.1 or 3.2 or 3.3 or 3.4 mm$^2$/s or greater, in cases 3.5 or 3.6 or 3.7 or 3.8 or 3.9 or even 4 mm$^2$/s or greater. Its VK 40 may be up to 4.5 or 4.4 or 4.3 mm$^2$/s. In certain cases, for example arctic diesel fuels, the VK 40 of the composition may be as low as 1.5 mm$^2$/s, although it is preferably 1.7 or 2.0 mm$^2$/s or greater. References in this specification to viscosity are, unless otherwise specified, intended to mean kinematic viscosity.

The composition preferably has a relatively high density, for example for a diesel fuel composition 830 kg/m$^3$ or greater at 15° C. (ASTM D-4052 or EN ISO 3675), preferably 832 kg/m$^3$ or greater, such as from 832 to 860 kg/m$^3$. Suitably its density will be no higher than 845 kg/m$^3$ at 15° C., which is the upper limit of the current EN 590 diesel fuel specification.

A fuel composition prepared according to the present invention may be for example an automotive gasoline or diesel fuel composition, in particular the latter.

A gasoline fuel composition prepared according to the present invention may in general be any type of gasoline fuel composition suitable for use in a spark ignition (petrol) engine. It may contain, in addition to the VI improving additive, other standard gasoline fuel components. It may, for example, include a major proportion of a gasoline base fuel, which will typically have a boiling range (ASTM D-86 or EN ISO 3405) of from 20 to 210° C. A "major proportion" in this context means typically 85% w/w or greater based on the overall fuel composition, more suitably 90 or 95% w/w or greater, most preferably 98 or 99 or 99.5% w/w or greater.

A diesel fuel composition prepared according to the present invention may in general be any type of diesel fuel composition suitable for use in a compression ignition (diesel) engine. It may contain, in addition to the VI improving additive, other standard diesel fuel components. It may, for example, include a major proportion of a diesel base fuel, for instance of the type described below. Again a "major proportion" means typically 85% w/w or greater based on the overall composition, more suitably 90 or 95% w/w or greater, most preferably 98 or 99 or 99.5% w/w or greater.

Thus, in addition to the VI improving additive, a diesel fuel composition prepared according to the present invention may comprise one or more diesel fuel components of conventional type. Such components will typically comprise liquid hydrocarbon middle distillate fuel oil(s), for instance petroleum derived gas oils. In general such fuel components may be organically or synthetically derived, and are suitably obtained by distillation of a desired range of fractions from a crude oil. They will typically have boiling points within the usual diesel range of 150 to 410° C. or 170 to 370° C., depending on grade and use. Typically the fuel composition will include one or more cracked products, obtained by splitting heavy hydrocarbons.

A petroleum derived gas oil may for instance be obtained by refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally a petroleum derived gas oil may comprise some petroleum derived kerosene fraction.

Such gas oils may be processed in a hydrodesulphurization (HDS) unit so as to reduce their sulphur content to a level suitable for inclusion in a diesel fuel composition.

A diesel base fuel may be or comprise a Fischer-Tropsch derived diesel fuel component, typically a Fischer-Tropsch derived gas oil. In the context of the present invention, the term "Fischer-Tropsch derived" means that a material is, or derives from, a synthesis product of a Fischer-Tropsch condensation process. The term "non-Fischer-Tropsch derived" may be interpreted accordingly. A Fischer-Tropsch derived fuel or fuel component will therefore be a hydrocarbon stream in which a substantial portion, except for added hydrogen, is derived directly or indirectly from a Fischer-Tropsch condensation process.

The Fischer-Tropsch reaction converts carbon monoxide and hydrogen into longer chain, usually paraffinic, hydrocarbons:

$$n(CO+2H_2)=(-CH_2-)_n+nH_2O+\text{heat},$$

in the presence of an appropriate catalyst and typically at elevated temperatures (e.g. 125 to 300° C., preferably 175 to 250° C.) and/or pressures (e.g. 0.5 to 10 MPa, preferably 1.2 to 5 MPa). Hydrogen:carbon monoxide ratios other than 2:1 may be employed if desired.

The carbon monoxide and hydrogen may themselves be derived from organic, inorganic, natural or synthetic sources, typically either from natural gas or from organically derived methane.

A Fischer-Tropsch derived diesel fuel component of use in the present invention may be obtained directly from the refining or the Fischer-Tropsch reaction, or indirectly for instance by fractionation or hydrotreating of the refining or synthesis product to give a fractionated or hydrotreated product. Hydrotreatment can involve hydrocracking to adjust the boiling range (see e.g. GB-B-2077289 and EP-A-0147873) and/or hydroisomerisation which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired fraction(s), typically gas oil fraction(s), may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table of the elements, in particular ruthenium, iron, cobalt or nickel. Suitable such catalysts are described for instance in EP-A-0583836.

An example of a Fischer-Tropsch based process is the Shell™ "Gas-to-liquids" or "GtL" technology (formerly known as the SMDS (Shell Middle Distillate Synthesis) and described in "The Shell Middle Distillate Synthesis Process", van der Burgt et al, paper delivered at the 5th Synfuels Worldwide Symposium, Washington D.C., November 1985, and in the November 1989 publication of the same title from Shell International Petroleum Company Ltd, London, UK). In the latter case, preferred features of the hydroconversion process may be as disclosed therein. This process produces middle distillate range products by conversion of a natural gas into a heavy long chain hydrocarbon (paraffin) wax which can then be hydroconverted and fractionated.

For use in the present invention, a Fischer-Tropsch derived fuel component is preferably any suitable component derived from a gas to liquid synthesis (hereinafter a GtL component), or a component derived from an analogous Fischer-Tropsch synthesis, for instance converting gas, biomass or coal to liquid (hereinafter an XtL component). A Fischer-Tropsch derived component is preferably a GtL component. It may be a BtL (biomass to liquid) component. In general a suitable XtL component may be a middle distillate fuel component, for instance selected from kerosene, diesel and gas oil fractions as known in the art; such components may be generically classed as synthetic process fuels or synthetic process oils. Preferably an XtL component for use as a diesel fuel component is a gas oil.

Diesel fuel components contained in a composition prepared according to the present invention will typically have a density of from 750 to 900 kg/m$^3$, preferably from 800 to 860 kg/m$^3$, at 15° C. (ASTM D-4052 or EN ISO 3675) and/or a VK 40 of from 1.5 to 6.0 mm$^2$/s (ASTM D-445 or EN ISO 3104).

In a diesel fuel composition prepared according to the present invention, the base fuel may itself comprise a mixture of two or more diesel fuel components of the types described above. It may be or contain a so-called "biodiesel" fuel component such as a vegetable oil, hydrogenated vegetable oil or vegetable oil derivative (e.g. a fatty acid ester, in particular a fatty acid methyl ester) or another oxygenate such as an acid, ketone or ester. Such components need not necessarily be bio-derived.

An automotive diesel fuel composition prepared according to the present invention will suitably comply with applicable current standard specification(s) such as for example EN 590 (for Europe) or ASTM D-975 (for the USA). By way of example, the overall fuel composition may have a density from 820 to 845 kg/m$^3$ at 15° C. (ASTM D-4052 or EN ISO 3675); a T95 boiling point (ASTM D-86 or EN ISO 3405) of 360° C. or less; a measured cetane number (ASTM D-613) of 51 or greater; a VK 40 (ASTM D-445 or EN ISO 3104) from 2 to 4.5 mm$^2$/s; a sulphur content (ASTM D-2622 or EN ISO 20846) of 50 mg/kg or less; and/or a polycyclic aromatic hydrocarbons (PAH) content (IP 391(mod)) of less than 11% w/w. Relevant specifications may, however, differ from country to country and from year to year, and may depend on the intended use of the fuel composition.

A diesel fuel composition prepared according to the present invention suitably contains no more than 5000 ppmw (parts per million by weight) of sulphur, typically from 2000 to 5000 ppmw, or from 1000 to 2000 ppmw, or alternatively up to 1000 ppmw. The composition may, for example, be a low or ultra low sulphur fuel, or a sulphur free fuel, for instance containing at most 500 ppmw, preferably no more than 350 ppmw, most preferably no more than 100 or 50 or even 10 ppmw, of sulphur.

An automotive fuel composition prepared according to the present invention, or a base fuel used in such a composition, may be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives (other than the VI improving additive described hereinabove), antioxidants and wax anti-settling agents. Thus, the composition may contain a minor proportion (preferably 1% w/w or less, more preferably 0.5% w/w (5000 ppmw) or less and most preferably 0.2% w/w (2000 ppmw) or less), of one or more fuel additives, in addition to the VI improving additive.

The composition may for example contain a detergent. Detergent-containing diesel fuel additives are known and commercially available. Such additives may be added to diesel fuels at levels intended to reduce, remove or slow the build up of engine deposits.

Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

A fuel additive mixture useable in a fuel composition prepared according to the present invention may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; antioxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; and wax anti-settling agents.

Such a fuel additive mixture may contain a lubricity enhancer (in addition to the viscosity improving (VI) additive described hereinabove), especially when the fuel composition has a low (e.g. 500 ppmw or less) sulphur content. In the additivated fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, III (1986) 217-235;
- WO-A-95/33805—cold flow improvers to enhance lubricity of low sulphur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the fuel composition to contain an anti-foaming agent, more preferably in combination with an anti-rust agent and/or a corrosion inhibitor and/or a lubricity enhancing additive.

Unless otherwise stated, the (active matter) concentration of each such additive component in the additivated fuel composition is preferably up to 10000 ppmw, more preferably in the range of 0.1 to 1000 ppmw, advantageously from 0.1 to 300 ppmw, such as from 0.1 to 150 ppmw.

The (active matter) concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The (active matter) concentration of any ignition improver present will preferably be 2600 ppmw or less, more preferably 2000 ppmw or less, conveniently from 300 to 1500 ppmw. The (active matter) concentration of any detergent in the fuel composition will preferably be in the range from 5 to 1500 ppmw, more preferably from 10 to 750 ppmw, most preferably from 20 to 500 ppmw.

If desired, one or more additive components, such as those listed above, may be co-mixed—preferably together with suitable diluent(s)—in an additive concentrate, and the additive concentrate may then be dispersed into a base fuel or fuel composition. The VI improving additive may, in accordance with the present invention, be incorporated into such an additive formulation.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the fuel composition may be suitably between 0 and 10000 ppmw and preferably below 5000 ppmw.

In this specification, amounts (concentrations, % v/v, ppmw, % w/w) of components are of active matter, i.e. exclusive of volatile solvents/diluent materials.

Different types and/or concentrations of additives may be appropriate for use in gasoline fuel compositions, which for example may contain polyisobutylene/amine and/or polyisobutylene/amide copolymers as detergent additives.

Suitably, the VI improving additive, and the concentration at which it is used in the fuel composition, will be such as to cause an increase in the cold filter plugging point (CFPP) of the composition of 10° C. or less, preferably 5 or 2 or 1° C. or less. Preferably it will be such as to cause no increase in CFPP. In cases it may be such as to cause a decrease in CFPP. Increases in CFPP may be as compared to the CFPP of the fuel composition prior to incorporation of the VI improving additive. They may be as compared to the CFPP of an otherwise analogous fuel composition which is intended (e.g. marketed) for use in an internal combustion (in particular diesel) engine, prior to adding a VI improving additive to it. CFPPs may be measured using the standard test method EN 116.

Suitably, the VI improving additive, and the concentration at which it is used in the fuel composition, will be such as to cause an increase in the cloud point of the composition of 10° C. or less, preferably 5 or 2 or 1° C. or less. Preferably it will be such as to cause no increase in cloud point. In cases it may be such as to cause a decrease in cloud point. Increases in cloud point may be as compared to that of the fuel composition prior to incorporation of the VI improving additive. They may be as compared to the cloud point of an otherwise analogous fuel composition which is intended (e.g. marketed) for use in an internal combustion (in particular diesel) engine, prior to adding a VI improving additive to it. Cloud points may be measured using the standard test method EN 23015.

In the context of the present invention, "use" of a VI improving additive in a fuel composition means incorporating the VI improving additive into the composition, typically as a blend (i.e. a physical mixture) with one or more fuel components (typically diesel base fuels) and optionally with one or more fuel additives. The VI improving additive is conveniently incorporated before the composition is introduced into an engine which is to be run on the composition. Instead or in addition the use may involve running an engine on the fuel composition containing the VI improving additive, typically by introducing the composition into a combustion chamber of the engine.

"Use" of a VI improving additive, in accordance with the present invention, may also embrace supplying such an additive together with instructions for its use in an automotive fuel composition to achieve one or more of the purpose(s) described above, in particular to improve the acceleration performance of an internal combustion (typically diesel) engine into which the composition is, or is intended to be, introduced.

The VI improving additive may itself be supplied as a component of a formulation which is suitable for and/or intended for use as a fuel additive, in particular a diesel fuel additive, in which case the VI improving additive may be included in such a formulation for the purpose of influencing its effects on the acceleration performance and/or power output of an engine into which a fuel composition is, or is intended to be, introduced.

Thus, the VI improving additive may be incorporated into an additive formulation or package along with one or more other fuel additives. It may, for instance, be combined, in an additive formulation, with one or more fuel additives selected from detergents, anti-corrosion additives, esters, poly alpha olefins, long chain organic acids, components containing amine or amide active centres, and mixtures thereof. In particular, it may be combined with one or more so-called performance additives, which will typically include at least a detergent.

The VI improving additive may be dosed directly into a fuel component or composition, for example at the refinery. It may be pre-diluted in a suitable fuel component which subsequently forms part of the overall automotive fuel composition.

In accordance with the present invention, two or more VI improving additives may be used in an automotive fuel composition for the purpose(s) described above.

According to a further aspect of the present invention, there is provided a process for the preparation of an automotive fuel composition, which process involves blending an automotive base fuel with a VI improving additive, wherein the VI improving additive is a functionalized dispersant olefin copolymer. The blending may be carried out for one or more of the purposes described above, in particular with respect to its effect on the acceleration performance and/or power output of an internal combustion engine into which it is, or is intended to be, introduced. The composition may in particular be a diesel fuel composition.

The VI improving additive may, for example, be blended with other components of the composition, in particular the base fuel, at the refinery. Alternatively, it may be added to an automotive fuel composition downstream of the refinery. It may be added as part of an additive package which contains one or more other fuel additives.

A further aspect of the present invention provides a method of operating an internal combustion engine, and/or a vehicle which is powered by such an engine, which method involves introducing into a combustion chamber of the engine a fuel composition described hereinabove. Again the fuel composition is preferably introduced for one or more of the purposes described in connection with the present invention. Thus, the engine is preferably operated with the fuel composition for the purpose of improving its power output and/or acceleration performance.

Again the engine may in particular be a diesel engine. It may be a turbo charged engine, in particular a turbo charged diesel engine. The diesel engine may be of the direct injection type, for example of the rotary pump, in-line pump, unit pump, electronic unit injector or common rail type, or of the indirect injection type. It may be a heavy or a light duty diesel engine. It may in particular be an electronic unit direct injection (EUDI) engine.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the present invention may be as described in connection with any of the other aspects.

Other features of the present invention will become apparent from the following examples. Generally speaking, the present invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the present invention are to be understood to be applicable to any other aspect, embodiment or example described herein unless incompatible therewith.

Moreover, unless stated otherwise, any feature disclosed herein may be replaced by an alternative feature serving the same or a similar purpose.

The following examples illustrate the properties of automotive fuel compositions prepared according to the present invention, and assess the effects of such compositions on the performance of a diesel engine.

EXAMPLES

Fuel blends were prepared by combining a diesel base fuel (meeting the European diesel fuel specification EN590) with a viscosity index (VI) improving additive. The viscosity index (VI) additive used in the present experiments was Hitec 5777, a functionalized olefin copolymer containing 8 functional groups and having a molecular weight of approximately 100,000, commercially available from Afton. Hitec 5777 is supplied as a viscous liquid concentrate containing 1-4.9% w/w active matter, having a viscosity at 100° C. of 1135 cSt. In the present experiments the Hitec 5777 was used at a treat rate of 10-49 mg/kg (1000 mg/kg as supplied).

Before being added to the diesel base fuel, the VI improving additive was pre-blended with Shellsol A150 solvent (commercially available from Shell). The weight ratio of VI improving additive to Shellsol A150 was 1:8.

The fuel specification of the diesel base fuel used in the present examples is shown in Table 1 below.

TABLE 1

Specification of Diesel Base Fuel (CEC RF-79-07)

| Property | Units | Limits Min. | Limits Max. |
|---|---|---|---|
| Cetane Number | — | 52.0 | 54.0 |
| Density at 15° C. | kg/m$^3$ | 833.0 | 837.0 |
| Distillation IBP | ° C. | — | — |
| Distillation 10% v/v | ° C. | — | — |
| Distillation 50% v/v | ° C. | 245.0 | — |
| Distillation 90% v/v | ° C. | — | — |
| Distillation 95% v/v | ° C. | 345.0 | 350.0 |
| Distillation FBP | ° C. | — | 370.0 |
| Flash Point | ° C. | 62 | — |
| CFPP | ° C. | — | −5 |
| Viscosity at 40° C. | mm$^2$/s | 2300 | 3300 |
| Aromatics, Total | % wt | — | — |
| Aromatics, Mono | % wt | — | — |
| Aromatics, Di | Wt % | — | — |
| Aromatics, Tri+ | Wt % | — | — |
| Aromatics, Poly (2 + 3) | % wt | 3.0 | 6.0 |
| Sulfur | mg/kg | — | 10 |
| Corrosion - Copper | | — | Max 1 |
| Carbon Residue on 10% Distillation Residue | % wt | — | 0.2 |
| Ash Content | % wt | — | 0.010 |
| Water | % wt | — | 0.0200 |
| Strong Acid Number | mg/KOH/g | — | 0.02 |
| Oxidation Stability | mg/mL | — | 0.025 |
| Carbon | % wt | — | — |
| Hydrogen | % wt | — | — |
| C:H Ratio (H = 1) | | — | — |
| H:C Ratio (C = 1) | | — | — |
| Net Heating Value | MJ/kg | — | — |
| Net Heating Value | Btu/lb | — | — |
| HFRR (wsd 1, 4) | μm | — | 400 |
| Element Analysis | | — | |
| Al | mg/kg | — | 0.1 |
| Ag | mg/kg | — | 0.1 |
| B | mg/kg | — | 0.1 |
| Ba | mg/kg | — | 0.1 |
| Ca | mg/kg | — | 0.1 |
| Cd | mg/kg | — | 0.1 |
| Ce | mg/kg | — | 0.1 |
| Cr | mg/kg | — | 0.1 |
| Cu | mg/kg | — | 0.1 |
| Fe | mg/kg | — | 0.1 |
| K | mg/kg | — | 0.1 |
| Mg | mg/kg | — | 0.1 |
| Sn | mg/kg | — | 0.1 |
| Mn | mg/kg | — | 0.1 |
| Mo | mg/kg | — | 0.1 |
| Na | mg/kg | — | 0.1 |
| Ni | mg/kg | — | 0.1 |
| P | mg/kg | — | 0.1 |
| Pb | mg/kg | — | 0.1 |
| Si | mg/kg | — | 0.1 |
| Sn | mg/kg | — | 0.1 |
| Ti | mg/kg | — | 0.1 |

TABLE 1-continued

Specification of Diesel Base Fuel (CEC RF-79-07)

| Property | Units | Limits Min. | Limits Max. |
|---|---|---|---|
| V | mg/kg | — | 0.1 |
| Ni | mg/kg | — | 0.1 |
| Zn | mg/kg | — | 0.1 |

Demonstration of Power Benefit

The fuel blends described above, containing a VI additive pre-blended in Shellsol A150, were used in a bench test engine in order to assess the effects of the VI improving additive on the power performance of an engine. The bench test engine chosen for this study was a PSA DW10B. This engine is specified in CEC F-98-09, the industry standard test for injector nozzle fouling in modern DI car engines, and as such there is a vast amount of historical test data available supporting the performance and characteristics of the engine. DW10B test details are listed in Table 2 below:

TABLE 2

| | |
|---|---|
| Manufacturer | Peugeot |
| Engine Code | DW10B |
| Displacement (ltr)/layout | 2.0/In line 4 |
| Max Power (kW) @ (rpm) | 100 kW@4000 r/min |
| Max Torque (Nm) (rpm) | 320 Nm@2000 r/min |
| Injection Type/Manufacturer | Common Rail (CR)/Continental, 1600 bar |
| EMS Manufacturer | Continental |
| Emissions Class | Euro 4 |
| Lubricant | Shell Helix Ultra |

A constant test speed of 4000 r/min was used and maximum accelerator pedal position (100% APP) was applied using DW10B CEC specification nozzles. The engine was run in cycles of 24 minutes per fuel, alternating between base fuel without additive and candidate fuel, and the power output was measured. The results of the power testing are set out in Table 3 below. The power benefit (%) is compared to the unadditised base fuel (containing Shellsol A150) (designated as Example 1 in Table 3).

TABLE 3

| E.g. | ppm of Shellsol A150 | VII | Dose of VII (mg/kg) | Power Benefit (%) |
|---|---|---|---|---|
| 1* | 8000 | — | — | — |
| 2 | 8000 | Hitec 5777 | 1000 mg/kg as supplied)** | 0.10 |

*Not according to the present invention

**Hitec 5777 is supplied in a mineral base oil comprising 1-4.9% w/w of the functionalised dispersant olefin copolymer

Discussion

The fuel blend which contained the functionalised dispersant olefin copolymer Hitec 5777 showed a statistically significant increase in power benefit when used at a treat rate of 1000 mg/kg as supplied (95% confidence) compared to the base fuel (containing Shellsol A150).

That which is claimed is:

1. A diesel fuel composition comprising a diesel base fuel and at least one viscosity index (VI) improving additive, wherein the viscosity index (VI) improving additive is a functionalized dispersant olefin copolymer produced from reacting an olefin copolymer with a functionalizing component selected from amines, amides, nitrogen-containing heterocyclic compounds or alcohols or produced from grafting an olefin copolymer with a grafting material and then reacting the grafted material with a functionalizing component selected from amines, amides, nitrogen-containing heterocyclic compounds or alcohols, wherein the olefin copolymer is a copolymer of ethylene with a $C_3$ to $C_{20}$ olefin, and wherein the concentration of the viscosity index (VI) improving additive in the fuel composition is from 0.001 to 1% w/w.

2. The fuel composition according to claim 1 wherein the $C_3$ to $C_{20}$ olefin is selected from propylene, butylene, butadiene, isoprene, and mixtures thereof.

3. The fuel composition according to claim 1 wherein the olefin copolymer is a copolymer of ethylene and propylene.

4. The fuel composition according to claim 1 wherein the grafting material is an unsaturated acid.

5. The fuel composition according to claim 1 wherein the grafting material is maleic anhydride.

6. The fuel composition according to claim 1 wherein the functionalizing component is an amine.

7. The fuel composition according to claim 6 wherein the amine is an aromatic amine.

8. The fuel composition according to claim 7 wherein the aromatic amine is N-phenyl-1,4-phenylenediamine.

9. The composition according to claim 1 wherein the concentration of the viscosity index (VI) improving additive in the fuel composition is from 0.001 to 0.5% w/w.

10. A method operating an internal combustion engine, and/or a vehicle which is powered by such an engine, which method involves introducing into a combustion chamber of the engine a fuel composition according to claim 1.

11. The composition according to claim 9 wherein the concentration of the viscosity index (VI) improving additive in the fuel composition is from 0.025 to 0.25% w/w.

12. A method for improving the power output of an internal combustion engine and/or a vehicle which is powered by such an engine, which method involves introducing into a combustion chamber of the engine a fuel composition according to claim 1 and combusting said fuel composition in said engine.

* * * * *